US006695592B2

(12) United States Patent
Yokomachi et al.

(10) Patent No.: US 6,695,592 B2
(45) Date of Patent: Feb. 24, 2004

(54) COMPRESSOR PROVIDED WITH PRESSURE RELIEF VALVE

(75) Inventors: Naoya Yokomachi, Kariya (JP); Kiyoshi Yagi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/092,120

(22) Filed: Mar. 5, 2002

(65) Prior Publication Data

US 2002/0146328 A1 Oct. 10, 2002

(30) Foreign Application Priority Data

Mar. 6, 2001 (JP) ..... 2001-061559

(51) Int. Cl.[7] ..... F04B 49/24
(52) U.S. Cl. ..... 417/308; 417/309
(58) Field of Search ..... 417/307, 308, 417/309, 311, 304, 220, 440

(56) References Cited

U.S. PATENT DOCUMENTS 5,584,673 A * 12/1996 Rein ..... 417/308
5,807,081 A * 9/1998 Schutte et al. ..... 417/309
6,149,401 A * 11/2000 Iwanami et al. ..... 417/307

FOREIGN PATENT DOCUMENTS

| | | |
|---|---|---|
| JP | 60-52228 | 3/1985 |
| JP | 6-43438 | 6/1994 |
| JP | 09-060588 | 3/1997 |
| JP | 09-264442 | 10/1997 |

* cited by examiner

*Primary Examiner*—Michael Koczo
(74) *Attorney, Agent, or Firm*—Morgan & Finnegan, LLP

(57) ABSTRACT

A compressor has a high-pressure relief valve and a low-pressure relief valve. The high-pressure relief valve in use for a discharge region opens when the pressure of gas in the discharge region is more than a first predetermined pressure. The high-pressure relief valve is provided with a first shim. The low-pressure relief valve in use for a suction region opens when the pressure of gas in the suction region is more than a second predetermined pressure which is lower than the first predetermined pressure. The low-pressure relief valve is provided with a second shim. The high-pressure relief valve and the low-pressure relief valve have similar structure to each other.

8 Claims, 2 Drawing Sheets

COMPRESSOR PROVIDED WITH PRESSURE RELIEF VALVE

BACKGROUND OF THE INVENTION

The present invention relates to a compressor and more particularly to a compressor provided with a pressure relief valve.

A piston type compressor such as a swash plate type compressor, generally, includes a suction chamber and a discharge chamber defined in a housing, and a cylinder block which is provided with a plurality of cylinder bores. The cylinder bores are each arranged to correspond to the suction chamber and the discharge chamber through a valve plate assembly. A piston is slidably disposed in each of the cylinder bores. During reciprocating movement of the piston, refrigerant in the suction chamber is drawn into each of the cylinder bores and the refrigerant in the cylinder bores are compressed and discharged into the discharge chamber.

Therefore, while the compressor is driven, the refrigerant in the discharge chamber becomes high in pressure and the refrigerant in the suction chamber becomes low in pressure. To lower the pressure of the refrigerant in the discharge chamber which has become extraordinarily high beyond a predetermined value, a compressor provided with a pressure relief valve is disclosed in Unexamined Japanese Patent Publication No. 9-60588.

When a compressor is provided with a pressure relief valve, the compressor operates safely since the pressure of refrigerant in a discharge chamber which has become extraordinarily high is lowered. If carbon dioxide is applied as refrigerant, refrigerant in the suction chamber as well as refrigerant in the discharge chamber becomes high in pressure. In this case, it is required that the pressure of the refrigerant in the suction chamber is also monitored.

When the discharge chamber and the suction chamber are each provided with a pressure relief valve, however, the pressure relief valves which are different from each other are required since the refrigerant in the discharge chamber is higher in pressure than the refrigerant in the suction chamber. This increases manufacturing cost.

SUMMARY OF THE INVENTION

The present invention addresses a compressor in which pressure of refrigerant in a discharge chamber and a suction chamber are monitored at low cost.

To achieve the above object, the present invention has following features. A compressor has a high-pressure relief valve and a low-pressure relief valve. The high-pressure relief valve in use for a discharge region opens when the pressure of gas in the discharge region is more than a first predetermined pressure. The high-pressure relief valve is provided with a first shim. The low-pressure relief valve in use for a suction region opens when the pressure of gas in the suction region is more than a second predetermined pressure which is lower than the first predetermined pressure. The low-pressure relief valve is provided with a second shim. The high-pressure relief valve and the low-pressure relief valve have similar structure to each other.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A compressor according to a first preferred embodiment of the present invention will be described with reference to FIGS. 1 and 2.

Figure 1:
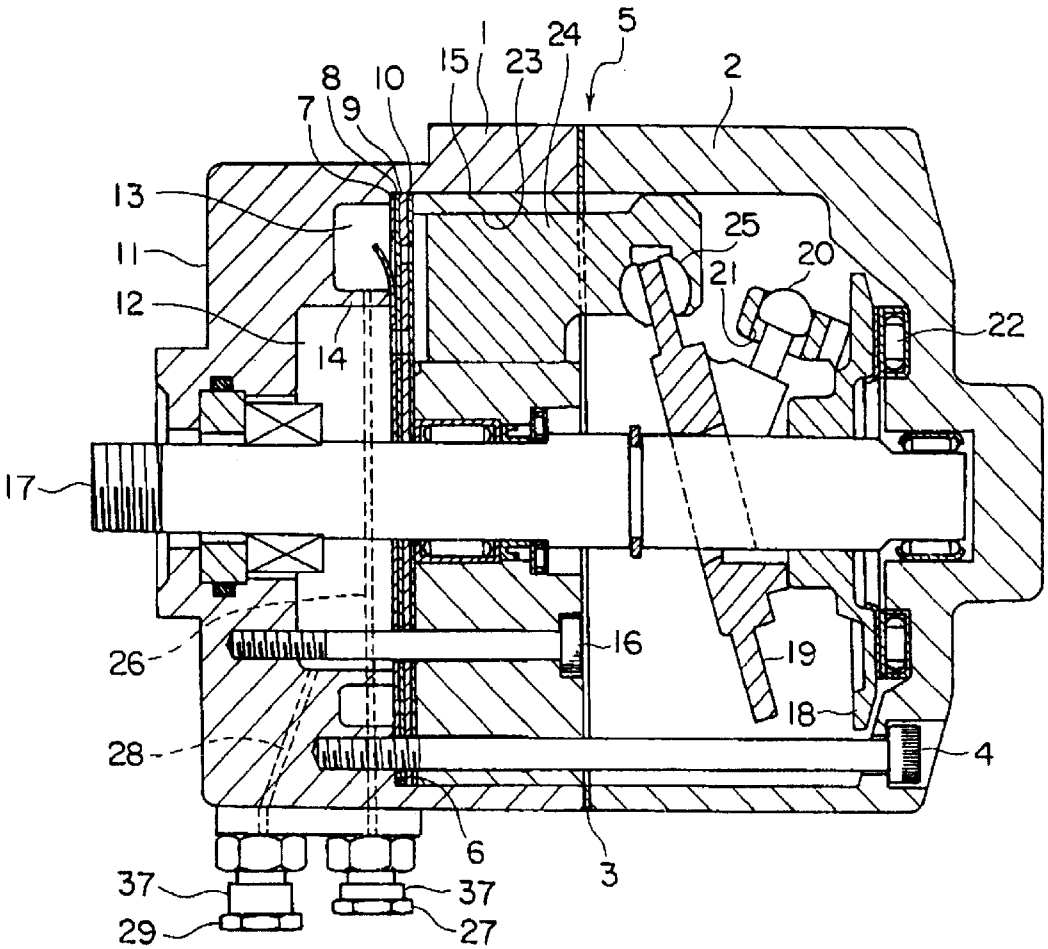
FIG. 1 is a diagram in a cross-sectional view illustrating a first preferred embodiment of a variable capacity swash plate type compressor according to the present invention.

As shown in FIG. 1, a front housing 1 and a rear housing 2 are fixedly bolted through a gasket 3 by a first bolt 4 to form a configuration of a housing 5. In the front housing 1, a step 6 is formed, and a retainer plate 7, a discharge valve plate 8, a valve plate 9 and a suction valve plate 1 0 are fitted into the housing 1 to secure the step 6. A suction chamber 12 and a discharge chamber 13 are defined between a front wall 11 of the front housing 1 and the retainer plate 7.

Also, still referring to FIG. 1, a cylinder block 15 is fitted into the front housing 1 to fix the suction valve plate 10. The front housing 1, the suction valve plate 10 and the cylinder block 15 are bolted by a second bolt 16. A drive shaft 17 is rotatably supported by the front housing 1, the rear housing 2 and the cylinder block 15. The front end of the drive shaft 17 extends outside of the front housing 1 and is connected to an external drive source such as a vehicle engine or a motor which is not shown in the drawings. In the rear housing 2, a rotor 18 is fixedly placed and a swash plate 19 is inclinably placed with respect to the drive shaft 17 to engage the rotor 18, respectively on the rear side of the drive shaft 17. A pair of guide pins 20 formed on the swash plate 19 is slidably fitted into a pair of guide holes 21 formed on the rotor 18. The swash plate 19 integrally rotates with the drive shaft 17 and is slidable in the direction of an axis of the drive shaft 17 by cooperation between the guide pins 20 and the corresponding guide holes 21. The rotor 18 is rotatably supported by a thrust bearing 22 in a rear wall of the rear housing 2.

A plurality of cylinder bores 23 is formed in the cylinder block 15 to surround the drive shaft 17. In each of the cylinder bores 23, a piston 24 is slidably disposed. Each piston 24 engages the swash plate 19 through a pair of shoes 25. As the swash plate 19 rotates with the drive shaft 17, each piston 24 reciprocates in the direction of the axis of the drive shaft 17 in the cylinder bores 23 through the shoes 25.

On an outer circumferential portion of the front housing 1, a high-pressure relief valve 27 is placed to communicate with the discharge chamber 13 through a first communication passage 26 while a low-pressure relief valve 29 is placed to communicate with the suction chamber 12 through a second communication passage 28. These pressure relief valves 27 and 29 have similar structure to each other.

The structure of the above pressure relief valves will be described with reference to FIG. 2. In FIG. 2, a pressure relief valve has a valve housing 30 and a holding member 35 which forms a through hole in its axis. The holding member 35 functioning as a cap screw is screwed into the valve housing 30. The holding member 35 and the valve housing 30 respectively serve as a first element and a second element in the claimed invention. The valve housing 30 and the holding member 35 define a valve chamber 31. In the valve chamber 31, a valve body 33 is slidably disposed. A seal 32 is arranged between the valve body 33 and the valve housing 30. A spring 34 for urging the valve body 33 against the valve housing 30 is also arranged between the valve body 33 and the holding member 35. A flange 36 of the holding member 35 and the valve housing 30 sandwich an annular shim 37 for controlling relief pressure.

Figure 2:
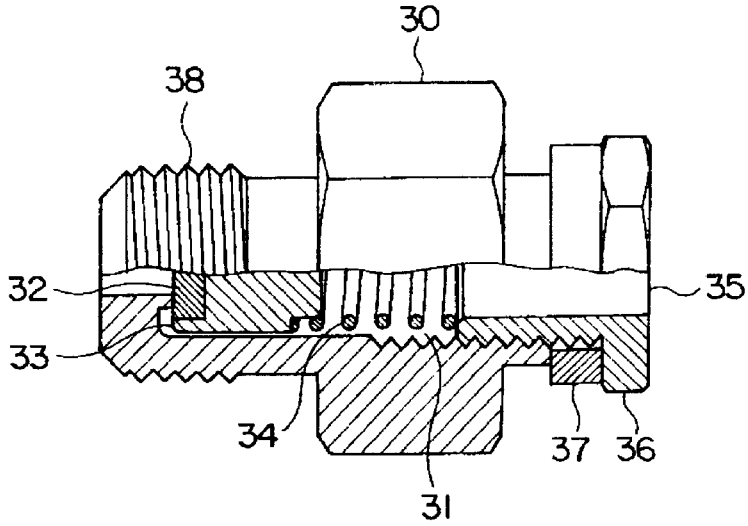
FIG. 2 is a diagram in a partial enlarged side view of FIG. 1, with a part cut away, which illustrates structure of a pressure relief valve in common use for a discharge chamber and a suction chamber in the first preferred embodiment of the variable capacity swash plate type compressor according to the present invention.

Still referring to FIG. 2, the pressure relief valve is screwed into the compressor by its screw portion 38. The pressure of refrigerant in the discharge chamber 13 and the pressure of refrigerant in the suction chamber 12 are applied to the valve body 33 in the valve housing 30 through the first and second communication passages 26 and 28, respectively. The valve body 33 is pressed against the spring 34. Since the urging force of the spring 34 is predetermined so as to exceed the pressing force of the refrigerant, normally the valve body 33 doesn't open. That is, the valve body 33 doesn't slide toward the holding member 35. However, the valve body 33 opens by sliding against the urging force of the spring 34 when the pressing force of the refrigerant exceeds the urging force of the spring 34 due to abnormal rise in pressure of the refrigerant. At this time, the high-pressure refrigerant is relieved through the valve chamber 31 and the through hole of the holding member 35 into atmosphere. Thus, the pressure of the refrigerant in the discharge chamber 13 and the suction chamber 12 are lowered.

The distance between the distal end of the holding member 35 and the opposing surface of the valve housing 30 is determined by varying the thickness of the shim 37. Therefore, the urging force of the spring 34 is determined due to the thickness of the shim 37. Accordingly, the urging force of the spring 34 is controlled by using the shims which are different from each other in thickness. That is, the pressure for opening the valve body 33 of the pressure relief valve is controllable.

Referring back to FIG. 1, the relatively thin shim 37 is in use for the high-pressure relief valve 27 to raise the relief pressure while the relatively thick shim 37 is in use for the low-pressure relief valve 29 to lower the relief pressure.

As described above, the high-pressure relief valve 27 and the low-pressure relief valve 29 have similar structure to each other and are alternatively in use by varying the thickness of the shim 37. Therefore, the relief pressure is set in high accuracy. In addition, the pressure of the refrigerant in the discharge chamber 13 and the suction chamber 12 are monitored at low cost. Moreover, since the spring 34 is pressed against the end surface of the holding member 35, torque control for the holding member 35 is easily performed. Therefore, the holding member 35 is not loosened.

A pressure relief valve for a compressor according to a second preferred embodiment of the present invention will be described with reference to FIG. 3. In the second embodiment, the pressure relief valve has a main body 39 functioning as a cap screw and a valve housing 41 which forms a through hole in its axis. The valve housing 41 is connected to the main body 39 by screwing. The main body 39 and the valve housing 41 respectively serve as the first element and the second element in the claimed invention. The main body 39 and the valve housing 41 define a valve chamber 42. In the valve chamber 42, a valve body 43 is slidably disposed. A seal 40 is arranged between the valve body 43 and the main body 39. A spring 44 for urging the valve body 43 against the main body 39 is also arranged between the valve body 43 and the valve housing 41. A flange of the main body 39 and the valve housing 41 sandwich an annular shim 45 for controlling relief pressure.

Figure 3:
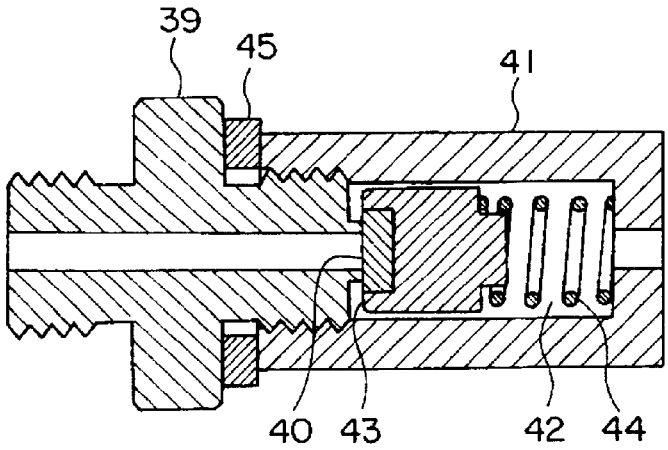
FIG. 3 is a diagram in a partial enlarged side view of FIG. 1, with a part cut away, which illustrates structure of a pressure relief valve in common use for a discharge chamber and a suction chamber in a second preferred embodiment of the variable capacity swash plate type compressor according to the present invention.

Still referring to FIG. 3, the distance between the valve body 43 and the opposing surface of the valve housing 41 is determined by varying the thickness of the shim 45. Therefore, the urging force of the spring 44 is determined due to the thickness of the shim 45. Accordingly, the urging force of the spring 44 is controlled by using the shims which are different from each other in thickness. That is, the pressure for opening the valve body 43 of the pressure relief valve is controllable.

In the present invention, carbon dioxide may be used as a refrigerant.

As described in detail, in the present invention, a compressor has a high-pressure relief valve and a low-pressure relief valve. The high-pressure relief valve is in use for a first relief pressure in a discharge chamber while the, low-pressure relief valve is in use for a second relief pressure, which is lower than the first relief pressure, in a suction chamber. The high-pressure relief valve and the low-pressure relief valve are each controllable in accordance with the thickness of the shim for controlling relief pressure. These pressure relief valves have similar structure to each other. Accordingly, the pressure relief valve is in common use for high-pressure and low-pressure by varying the thickness of the shim. Thus, the pressure of the refrigerant in the discharge chamber and the suction chamber are monitored at low cost.

The present examples and preferred embodiments are to be considered as illustrative and not restrictive and the invention is not to be limited to the details given herein but may be modified within the scope of the appended claims.

What is claimed is:

1. A compressor for compressing gas, the compressor having a suction region and a discharge region in a compressor housing, the gas being introduced into the suction region, the gas being compressed and discharged into the discharge region, the compressor comprising:

a high-pressure relief valve placed on the compressor housing in use for the discharge region, wherein the high-pressure relief valve opens when the pressure of the gas in the discharge region is more than a first predetermined pressure, the high-pressure relief valve having a first element, a second element and a first shim, the first element and the second element being connected to each other so as to sandwich the first shim, the first predetermined pressure being determined in accordance with thickness of the first shim; and a low-pressure relief valve placed on the compressor housing in use for the suction region, wherein the low-pressure relief valve opens when the pressure of the gas in the suction region is more than a second predetermined pressure which is lower than the first predetermined pressure, the low-pressure relief valve having a third element, a fourth element and a second shim, the third element and the fourth element being connected to each other so as to sandwich the second shim, the second predetermined pressure being determined with thickness of the second shim, wherein the high-pressure relief valve and the low-pressure relief valve have similar structure to each other.

2. The compressor according to claim 1 wherein the first predetermined pressure and the second predetermined pressure are determined by the thickness of the first shim and the second shim, respectively, and wherein the first shim and the second shim have different thicknesses from each other.

3. The compressor according to claim 1 wherein the first shim is thinner than the second shim.

4. The compressor according to claim 1 wherein the high-pressure relief valve and the low-pressure relief valve are detachable from the compressor, respectively.

5. The compressor according to claim 1 wherein the high pressure relief valve and the low-pressure relief valve comprises:

a first valve chamber defined between the first element and the second element;

a first valve body disposed in the first valve chamber, to which the pressure of the gas in the discharge region is applied for relieving the gas in the discharge chamber into atmosphere;

a first spring disposed in the first valve chamber, to prevent the first valve body from relieving the gas in the discharge chamber into atmosphere;

a second valve chamber defined between the third element and the fourth element;

a second valve body disposed in the second valve chamber, to which the pressure of the gas in the suction region is applied for relieving the gas in the suction region into atmosphere; and a second spring disposed in the second valve chamber so as to prevent the second valve body from relieving the gas in the suction region into atmosphere.

6. The compressor according to claim 5 wherein the first element and the second element are connected to each other by screwing.

7. The compressor according to claim 1 wherein the gas is carbon dioxide.

8. The compressor according to claim 1, wherein at least one of the first shim and the second shim has an annular shape.

* * * * *

UNITED STATES PATENT AND TRADEMARK OFFICE

CERTIFICATE OF CORRECTION

PATENT NO. : 6,695,592 B2
DATED : February 24, 2004
INVENTOR(S) : Yokomachi et al.

It is certified that error appears in the above-identified patent and that said Letters Patent is hereby corrected as shown below:

Column 4,
Line 24, please delete “while the, low-” and insert therefore -- while the low- --.

Column 6,
Line 1, please delete “chamber, to” and insert therefore -- chamber to --.

Signed and Sealed this

Fifteenth Day of June, 2004

JON W. DUDAS
*Acting Director of the United States Patent and Trademark Office*